US005875764A

United States Patent [19]

Kappel et al.

[11] Patent Number: 5,875,764

[45] Date of Patent: Mar. 2, 1999

[54] APPARATUS AND METHOD FOR VALVE CONTROL

[75] Inventors: Andreas Kappel; Randolf Mock, both of Munich; Hans Meixner, Haar, all of Germany; Edward-James Hayes, Virginia Beach, Va.

[73] Assignees: Siemens Aktiengesellschaft, Munich, Germany; Siemens Automotive Corporation, Auburn Hills, Mich.

[21] Appl. No.: 78,078

[22] Filed: May 13, 1998

[51] Int. Cl.[6] ..... F02M 41/00

[52] U.S. Cl. ..... 123/467; 123/446

[58] Field of Search ..... 123/446, 447, 123/467, 498

[56] References Cited

U.S. PATENT DOCUMENTS

| | | | |
|---|---|---|---|
| 4,798,186 | 1/1989 | Ganser | 123/467 |
| 4,957,085 | 9/1990 | Suerdlin | 123/467 |
| 5,176,120 | 1/1993 | Takahashi | 123/467 |
| 5,339,786 | 8/1994 | Martin | 123/467 |
| 5,638,791 | 6/1997 | Tsuzuki | 123/467 |
| 5,664,545 | 9/1997 | Kato | 123/467 |
| 5,711,274 | 1/1998 | Drummer | 123/467 |
| 5,775,301 | 7/1998 | Ganser | 123/467 |

*Primary Examiner*—Carl S. Miller
*Attorney, Agent, or Firm*—Hill & Simpson

[57] ABSTRACT

An easily controllable primary drive (5) guided in a first bore (3), for example a piezo actuator, transmits its stroke by a piston-hydraulic stroke transmission with a hydraulic chamber (2) onto a stroke element (70) of the secondary side guided in a second bore (4). The pressure in a valve chamber (9) is controlled via the stroke element (7) of the secondary side.

34 Claims, 4 Drawing Sheets

APPARATUS AND METHOD FOR VALVE CONTROL

BACKGROUND OF THE INVENTION

The significance of a fast and precise control of valve systems is increasing with an increase demand for hydraulic systems. One example of such a field of activity is fuel injection, for example direct injection of diesel fuel into the combustion chamber of a motor. What is referred to as the "common rail" system wherein the fuel is conveyed from a central conveying pump into a filling conduit ("common rail") shared by all cylinders thereby has great potential. The dosing of the fuel ensues via a system for fuel injection that is individually allocated to each and every cylinder. The improvement of the motor operating behavior that can be achieved with the assistance of a common rail injection system thereby essentially results from an injection pressure of up to 2500 bar that can be regulated independently of the motor speed. Added thereto given this technology is the possibility of shaping the course of the injection, i.e. of generating a single or multiple pilot injection, or of the control of the injection rate as well as the free control of characteristics of start of injection and injected amount.

For realizing these advantages, the system for fuel injection must satisfy a very high dynamic demand; for example, it must exhibit a short drive dead time and a short switching time.

Up to now, the control of common rail injectors has essentially ensued with the assistance of a solenoid drive. In some instances, the injector is also controlled with the assistance of a piezo-hydraulic drive.

In the control of a fuel injector with the assistance of a piezoelectric direct drive for valve control of the hydraulic system, the problem arises, for example, that only an inadequate compensation of a change in length of piezo actuator and housing caused by temperature effects or by aging and settling effects is realized. Added thereto is that a piezo actuator having a large structural length is required given piezo direct drive, which is disadvantageous in terms of manufacturing technology and in view of the manufacturing costs.

Numerous problems such as, for example, an involved mechanical balancing, a risk of breaking the diaphragm and well as a low efficiency of the diaphragm-type hydraulics arise given a combination of the piezo actuator with a diaphragm-type hydraulics for valve control in the injection system. Also unsatisfactory are, for example, the influence of pressure waves, a problematical temperature compensation as well as a merely satisfactory switching behavior.

Another example for the employment of a fast valve control is the braking circulation of a vehicle, whereby the hydraulic pressure in an anti-blocking system must be regulated precisely and fast. The employment of a fast and precise valve control in the hydraulic circulation of an elevator control or, respectively, vertical rudder in an aircraft is also conceivable. The guidance rudder must thereby be driven very fast in order to assure the safety of the aircraft, particularly in modern aircraft designed aerodynamically unstable.

SUMMARY OF THE INVENTION

The object of the present invention is to offer a possibility for precise valve control that also reduces the effect of an operation-induced or aging-induced influence on the switching behavior.

The idea of the invention is comprised in utilizing an easily controllable primary drive with short switching time whose stroke is forwarded by a piston-hydraulic stroke transmission.

The primary drive, i.e. a drive directly controllable from the outside, is axially displaceably attached in a first bore of a housing. The fit between primary drive and housing can thereby leak or, advantageously, can be hydraulically tight. The primary drive preferably has a linear response behavior, for example on the basis of a piezo actuator whose change in length is linear, in a very good approximation, to an electrical signal applied to the actuator. Other suitable drive elements are, for example, electrostrictive or magnetostrictive actuators. The first bore and a second bore discharge into a fluid-filled hydraulic chamber. A stroke [or: lift] element that can also be composed of different types of sub-elements is introduced in the second bore with leakage and axially displaceable. Via the hydraulic chamber, the primary drive thus has a hydraulic frictional connection with the stroke [or: lift] element attached at the secondary side.

Below, "primary side" refers to elements that, in frictional connection, are attached from the primary drive exclusively up to the hydraulic chamber, for example a piezo actuator or a restoring element of the primary side for the piezo actuator. "Secondary side" refers to corresponding elements that, in frictional connection, follow the primary drive and the hydraulic chamber, for example a stroke element or, respectively, a stroke piston or a ram.

Two advantages, among others, derive due to the employment of the hydraulic chamber:

(1) A stroke of the primary drive that is possibly too slight for the valve control is enlarged to such an extent by the stroke transmission onto the stroke element of the secondary side that this stroke is adequate for the valve control (for example: 40 $\mu$m stroke of the piezo actuator, 240 $\mu$m stroke of the stroke element, corresponding to a stroke transmission of 6:1). Due to the stroke transmission, the advantages of the primary drive, namely a very fast and linear response behavior, are united with the advantages of an adequate stroke. Moreover, a disadvantage of the piezoelectric direct drive, namely a great piezo length, is avoided.

(2) Length changes both of the piezo actuator as well as of the housing together with built-ins caused by thermal or by aging as well as settling effects are largely compensated. This advantage is realized in that the hydraulic chamber is pressure-charged with fluid via a common rail, whereby the pressure of the fluid in the common rail is basically independent of the volume of the hydraulic chamber. Given employment of a non-inventive double diaphragm for the hydraulic force transmission, for example, these length influences could change the volume within the double diaphragm and, thus, the pressure within the double diaphragm to such an extent that the force transmission between primary drive and secondary stroke element is quantitatively changed.

Fluid losses due, for example, to a leakage the fit [sic] between the stroke element of the secondary side and the bore surrounding it are also compensated via the common rail. The hydraulic chamber can also be aerated, for example upon initial utilization, via the feeder and an additionally attached aeration screw.

For realizing the piston-hydraulic stroke transmission, the pressure-active area of the primary drive with reference to the fluid in the hydraulic chamber must be larger than that of the stroke element of the secondary side. The "pressure-active area" thereby refers to the projection of the area in contact with the fluid of the hydraulic chamber in the indicated direction. For example, the pressure-active area of a cylinder piston discharging perpendicularly into the hydraulic chamber corresponds to the end face of this cylinder.

For valve control, the motion of the stroke element of the secondary side is employed for closing a fluid-filled valve chamber off to prevent a discharge to a lower pressure level. Typically, a hydraulic or hydraulic-mechanical system is controllable via the pressure of the fluid in the valve chamber.

The valve control basically sequences in the following steps:

(a) In quiescent position, the primary drive is at a maximally great distance from the hydraulic chamber or, respectively, the second bore, for example given discharged piezo actuator. The pressure of the fluid in the hydraulic chamber corresponds to the pressure in the common rail. The stroke element of the secondary side is pressed in the direction of the hydraulic chamber by the restoring element of the secondary side and is maximally displaced to the hydraulic chamber. The stroke element closes the pressure-charged valve chamber to prevent a discharge. When the second bore advantageously discharges into the valve chamber at the end of the second bore opposite the hydraulic chamber, the stroke element is additionally pressed in the direction of the hydraulic chamber by the pressure of the fluid in the valve chamber.

(b) During the stroke event, the primary drive is displaced in the direction of the hydraulic chamber, for example by applying an electrical signal. Since the volume of the hydraulic chamber is lowered, the pressure therein is raised. The pressure against the stroke element of the secondary side is therefore in turn increased, so that this is more strongly pressed away from the hydraulic chamber.

Beginning with a specific pressure in the hydraulic chamber, the forces exerted on the stroke element in the direction of the hydraulic chamber are overcome and it moves away from the hydraulic chamber. Due to this motion, the stroke element is displaced into the valve chamber and thus opens a connection between the valve chamber and the outlet. As a result thereof, the fluid flows from the valve chamber into the outlet and the pressure in the valve chamber is lowered. Due to the pressure drop in the valve chamber and the thereby reduced opposing force onto the stroke element of the secondary side, this is displaced even farther into the valve chamber.

For achieving a predetermined maximum stroke, it is advantageous when a detent is present for limiting the stroke of the of the stroke element of the secondary side. A typical opening behavior of the valve control can thus be set such that, after initially overcoming a high opposing force, the stroke element is maximally displaced within a short time, i.e. the valve chamber is maximally opened. Such a control behavior has the advantage that the effect of a possible manufacturing difference, for example in the manufacture of a seal, is reduced.

(c) For the return into the quiescent position, the primary drive is moved away from the hydraulic chamber, for example by discharging a piezo actuator. The pressure of the fluid in the hydraulic chamber drops to such an extent that the restoring element of the secondary side and, potentially, the fluid in the valve chamber again displaces the stroke element in the direction of the hydraulic chamber. When the stroke element of the secondary side has been pushed back in the direction of the hydraulic chamber to such an extent that it again closes the valve chamber off from the outlet, then the pressure present in the quiescent condition is again built up in the valve chamber. The pressure present in the quiescent condition is also reestablished in the hydraulic chamber.

This valve control has the advantage that the relative alignment of the bores at the primary or, respectively, secondary side has no influence on the control behavior. For example, a plurality of sub-elements of the secondary side, for example stroke elements in their respective bores, can be integrated into the valve control.

By contrast to a mechanical transmitter system, the disadvantageous effect of the bending of components or of the friction or, respectively, wear or of a canting of mechanical components as well is eliminated.

Compared to a valve control with motion reversal, the advantage of a simple design in the region of the hydraulic chamber derives.

Due to the employment of a piezo actuator, a high pressure force of the actuating drive is available, connected with a very high drive precision and a very short dead time.

Due to the employment of a primary drive with a short dead time that can be very easily controlled, for example a piezo actuator, the valve control can be precisely controlled in the same way.

It is advantageous when a pressure piston as part of the primary drive is let in at least partially let-in in the first bore, this being arranged axially displaceable therein and, additionally advantageously, in sealing fashion without leakage. Given such a design, the hydraulic chamber can be limited by the housing and the piston. The pressure piston is advantageously subjected to excursion by a separate actuating drive, for example a piezo element, that lies against the side of the piston facing away from the hydraulic chamber. The actuating drive is supported, for example, at the housing. This design has the further advantage that the primary drive can be constructed of more simply worked discrete parts that can be respectively mechanically or, respectively, structurally optimized. As a result, for example, of the design as open system, a specific protection of the actuating drive against a chemical action of the fluid can be foregone.

The pressure piston, which need not be rigidly connected to the actuating drive, is advantageously pressed away from the hydraulic chamber by a restoring element of the primary side, for example a spring. The restoring element of the primary side also advantageously serves for the mechanical pressure pre-stress with which, for example, a ceramic-like actuating drive is protected against damage due to tensile stresses.

It is also advantageous when a spherical disk with corresponding abutment is attached between actuating drive and pressure piston, so that tilting or, respectively, gap resiliency given end faces that are not plane-parallel are compensated. The abutment, for example, can be integrated in the pressure piston. Alternatively, the spherical washer with the corresponding abutment can also be attached between the actuating drive and the housing.

The stroke element of the secondary side is advantageously designed such that it comprises a stroke piston at its side facing toward the hydraulic chamber and comprises a seal element, for example a valve disk, at its end adjoining the valve chamber. The motion of the stroke piston toward the seal element is transmitted, for example, by a ram connected thereto. The stroke piston is thereby attached in the bore axially displaceable and with leakage, whereas the ram has a significantly smaller diameter than the bore. Whereas, thus, a comparatively slight leakage out of the hydraulic chamber is caused by the comparatively tight fit between stroke piston and bore, the fluid cam proceed from the valve chamber to the outlet without significant throttling.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawing, in which:

DESCRIPTION OF THE PREFERRED EMBODIMENTS

Figure 1:
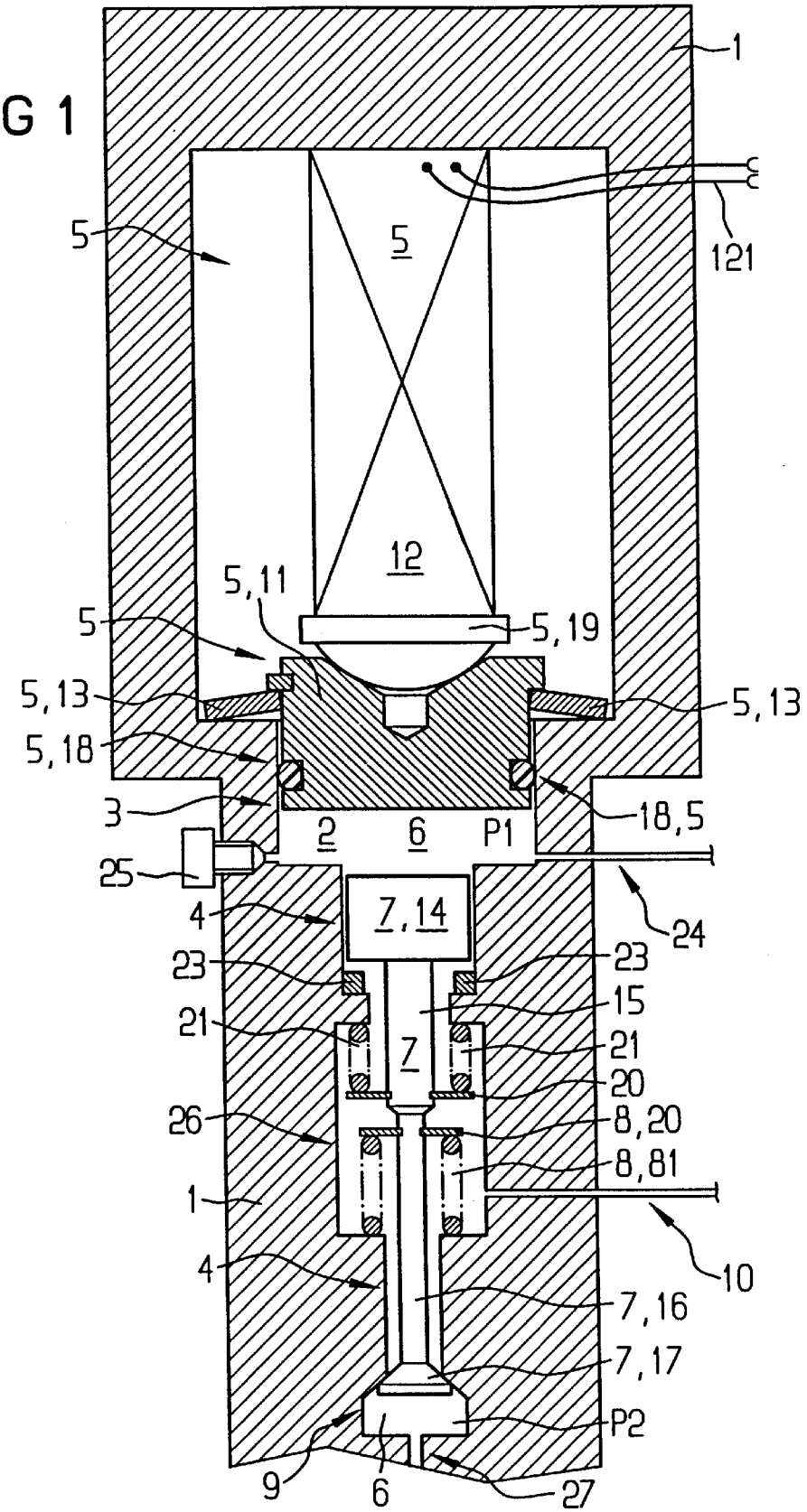
FIG. 1 shows a possible embodiment of the valve control.

In a side view, FIG. 1 shows an exemplary embodiment of a valve control in section. A first bore 3 is introduced in a housing 1. A pressure piston 11, as part of a primary drive 5, is axially displaceably arranged in the first bore 3 at least partially submerging. As a result of this arrangement, a hydraulic chamber 2 that is limited by the housing 1 and the pressure piston 11 is created within the first bore 3. The pressure piston 11 is pressed away from the hydraulic chamber 2 by a restoring element 13 of the primary side. The restoring element 13 of the primary side can, for example, be a tube spring (hollow cylinder with horizontal slots) or it can be advantageously composed of a plurality of saucer springs arranged parallel or serially. Proceeding from its side facing away from the hydraulic chamber 2, the pressure piston is moved by an actuating drive 12, whereby the actuating drive 12 is supported at the housing 1.

The actuating drive 12—as further sub-element of the primary drive 5—is advantageously a piezo element, advantageously a multi-layer piezo actuator. A piezo actuator has the advantage that it reacts very quickly to control signals and its change in length is—in a very good approximation—linear to the height of the control signal, for example of voltage or current signal. The employment of a piezo multi-layer system is thereby advantageous in terms of manufacturing technology. In addition to a piezo actuator, for example, a magnetostrictive or electrostrictive actuating element 12 can also be employed.

A spherical disk 19 that comprises a corresponding abutment at the pressure piston 11 is introduced between actuating drive 12 and pressure piston 11 and can advantageously compensate tilting of the piezo actuator, of the housing 1 or of the pressure piston 11, for example for avoiding gap resiliency given piezo end faces that are not plane-parallel. The spherical disk 19 with corresponding abutment can also be attached at the housing side between actuating drive 12 and housing 1. Given adequate fit precision, the spherical disk 19 can be omitted.

The elements (5, 11, 112, 13, 19) of the primary side are mounted such that they are mechanically pressure-prestressed in a defined fashion. This, for example, is advantageous given utilization of a ceramic actuating drive 12, for example a ceramic-like piezo actuator that can be easily destroyed by tensile stresses. The pressure prestress can by additionally set via spacers (not shown) attached to the housing 1.

Of course, the primary drive 5 can also be present as an individual element, for example as piston-shaped piezo actuator. However, the advantages of an optimized design of sub-elements with, for example, a contradictory demand of the material properties must thereby be foregone.

A circumferential O-ring 18, advantageously of elastomer material, that is let into a channel of the pressure piston 11 is employed for sealing the fit between pressure piston (5, 11) and first bore 3. The seal of the fit between pressure piston 11 and housing 1 advantageously prevents the fluid 6 situated in the hydraulic chamber 2 from emerging in the direction of the actuating drive 12.

The hydraulic chamber 2 is pressure-charged with a fluid 6 by means of a filling conduit 24. The filling conduit 24 can either be implemented throttled or can be equipped with a filling valve 41 that opens into the hydraulic chamber 2. A second bore 4 in which a stroke element 7 of the secondary side is arranged axially displaceable and with leakage discharges into the hydraulic chamber 2. Both bores 3 and 4 are cylindrical and centered relative to one another. They can also be interpreted as one bore with different diameter. Such an arrangement of two bores 3 and 4 discharging in one another with a longitudinal axis along the same line yields the advantage of a simple and compact structure, connected with a simple manufacturing possibility.

The utilization of the fluid-filled hydraulic chamber 2 offers the advantage that the orientation of the two bores 3, 4 relative to one another can be arbitrary, for example offset or tilted relative to one another. It also unproblemmatically offers the possibility of controlling a plurality of sub-elements (for example, 4, 7, 9) of the secondary side via a common hydraulic chamber 2.

The stroke element 7 of the secondary side is implemented such that it is composed of a stroke piston 17 adjoining the hydraulic chamber 2 that is arranged in the second bore 4 axially displaceable and with leakage. Toward the valve chamber 9, the stroke piston 14 is followed by a piston rod 14. A ram 16 adjoins that side of the piston rod 15 facing toward the valve chamber 9, this ram 16 being in turn connected to a seal element 17 that closes the valve chamber 9 off from the outlet 10.

A part of the second bore 4 is fashioned in the form of a gradual shutoff chamber 26 in which the restoring element 8 of the secondary side is attached. The restoring element 8 of the secondary side is composed of a coil spring 81 that is secured to the ram 16 with a Seeger ring 20, a snap ring or some similar fastening mechanism. In this exemplary embodiment, the piston rod 15 and the ram 16 are not connected to one another fixed. On the contrary, the piston rod 15 is held seated with the ram 16 by a coil compression spring 21. The coil compression spring 21 is thereby fixed to the piston rod 15 with a Seeger ring 20, snap ring of the like. This design has the advantage, for example, that the influence of pressure spikes in the fluid 6 on the stroke piston 14 is alleviated. The coil spring forces and the hydraulic forces are thereby matched such that, in the quiescent condition, the valve chamber 9 is closed off from the outlet 10 discharging into the gradual shutoff chamber 26.

For simplified manufacture, for example, a single component part given different bore diameters of the second bore 4 can also be employed instead of the piston rod 15 and the ram 16.

The seal element 17, which is worked in the form of a disk valve, closes the valve chamber 9 filled with a fluid 6 via a throttled feeder 27 off from the outlet 10.

(a) Quiescent position

In quiescent position, the actuating drive 12 fashioned as piezo actuator is discharged or, respectively, shorted, so that it has its minimum length in axial direction and is maximally distant from the second bore 4.

The hydraulic chamber 2 is filled with the fluid 6 residing under a pressure P1, whereby P1 corresponds to static [?] pressure of, typically, 1–25 bar adjacent at the filling conduit.

Due to the leakage between stroke piston 14 and housing 1, fluid 6 escapes from the hydraulic chamber 2 and is discharged via the outlet 10 that is unpressurized or, respectively, at a low static pressure level, for example up to 0–25 bar. A continuous flushing stream through the hydraulic chamber 2 thus derives. The flushing stream assures the bubble-free filling of the hydraulic chamber 2 since residual gas bubbles remaining in the hydraulic chamber 2 can be dissolved in the flushing stream. For simplified filling of the hydraulic chamber 2 with fluid 6, an aeration screw 25 is also additionally present that regulates a discharge from the hydraulic chamber 2 through the housing 1. During operation of the valve control, the aeration screw 25 will be understandably closed.

The pressure piston 11 is pressed against the actuating drive 12 or, respectively, the spherical disk 19 by the restoring element 13 of the primary side as well as by the pressure P1 of the fluid 6 in the hydraulic chamber 2. At the same time, the fluid 6 in the hydraulic chamber 2 pushes the stroke piston 14 away from the hydraulic chamber 2. Given the presence of a spring 21, this force is supported by said spring 21. On the other hand, the forces of the restoring element 8 of the secondary side—those of a spring 81 here—act on the stroke element 7 of the secondary side. Additionally, the stroke element P2 of the secondary side is pressed in the direction of the hydraulic chamber 2 by the pressure P2 of the fluid 6 located in the valve chamber 9 against the pressure-active surface of the seal element 17.

In the quiescent position, the forces at the stroke element 7 of the secondary side are dimensioned such that the seal element 17 closes the valve chamber 9 off from the outlet 10.

Typically, the pressure P2 of the fluid 6 situated in the valve chamber 9 for an injection system for diesel fuel lies in the range of 100–2500 bar.

(b) Stroke event

At the beginning of the stroke event, the actuating drive 12 fashioned as piezo actuator is stretched via the terminals 121 in axial direction, typically 10–60 $\mu$m, by an electrical signal, for example a voltage or current signal. Given such a slight displacement of the actuating drive 12, the O-ring 18 does not slide along the wall of the housing 1 but deforms purely elastically, as a result whereof an advantageous seal is achieved.

Via the spherical disk 19, the piezo actuator presses the pressure piston 11 in the direction of the hydraulic chamber 2 with great force, so that the pressure P1 in the hydraulic chamber 2 rises.

When the filling conduit 24 is equipped with a filling valve 41 opening in the direction of the hydraulic chamber 2, this closes due to the excess pressure (with reference to the static pressure) arising in the hydraulic chamber 2. When the filling conduit 242 is a throttled conduit without valve, for example a bore with adequately small diameter, then it is advantageous when the pressure piston 11, due to the motion of the pressure piston 11, slides past the discharge of the filling conduit 24 in the hydraulic chamber 2 as soon as possible, so that a leakage of fluid 6 out from the hydraulic chamber 2 via the filling conduit 24 is minimized.

Due to the increased pressure P1, the force exerted on the stroke element 7 of the secondary side in the direction of the valve chamber 9 is increased. When the force exerted in the direction of the valve chamber 9 exceeds the force of the restoring element 8 of the secondary side acting in the opposite direction and the force of the pressure P2, the stroke piston 7 moves into the valve chamber 9 and the connection between the valve chamber 9 and outlet 10 opens. The fluid 6 in the valve chamber 9 flows off via the outlet 10, as a result whereof the pressure P2 is reduced. The conduit 27 into the valve chamber 2 is throttled, so that the fluid discharge cannot be replenished with the same rate.

The pressure drop is all the greater the higher the pressure difference between P2 and the pressure pending at the outlet. For example, the drop of the pressure given P2=1000–2500 in quiescent position and an unpressurized outlet ensues nearly suddenly. An only slight pressure at the outlet 10 or, respectively, in the gradual shutoff chamber 26 is additionally advantageous because the effect of a pressure wave occurring in the gradual shutoff chamber 26 is then kept small. This could otherwise deteriorate the function of the piezohydraulic drive.

The stroke of the stroke piston 14, typically 60–360 $\mu$m, is limited by a detent 23. The system is thereby designed such that, given detent of the stroke piston 14, an adequate pressure or, respectively, force reserve is still present so that the stroke element 7 is opened for an adequate time despite leakage occurring at the hydraulic chamber 2. On the other hand, the leakage is dimensioned such that, for example given an interruption of the electrical connections 121 in the charged condition of the piezo actuator, an automatic return of the stroke element 7 into the quiescent position is advantageously assured.

(c) Return into quiescent position.

The stroke event is ended by the discharge of the piezo actuator. Upon contraction of the piezo actuator, the mechanically highly prestressed saucer spring 13 effects the resetting of the pressure piston 11 and of the spherical disk 19. If the hydraulic chamber 2 is filled with fluid 6 via the filling valve 41, the pressure P1 drops briefly below the static pressure due to the leakage occurring during the actuation duration. The filling valve 41 subsequently opens and the fluid losses are compensate in a short time. If the hydraulic chamber 2 is filled with fluid 6 via a throttled filling conduit 24, the pressure P1 in the hydraulic chamber can fall briefly considerably below the pressure level in quiescent position. In order to avoid cavitations, the leakage between stroke element 7 and housing 1 that is possible during the maximum stroke duration should be advantageously dimensioned such that the pressure variation in P1 does not exceed 1 bar.

Upon relaxation of P1 to the static pressure, the stroke element 7, 14–17 is reset by the spring 81 and the valve chamber 9 is closed relative to the outlet 10. Via the throttled feeder, the valve chamber 9 is again charged to the full pressure P2 adjacent in quiescent position.

The valve control constructed in the above-described way is advantageously distinguished in that its function is assured in a great range of the operating temperature. This is achieved by the leakages with which a compensation of length changes of actuating drive 12 or, respectively, housing 1 caused by temperature or by aging or settling effects is achieved. The advantage additionally derives that this valve control is significantly less sensitive to tolerances from a manufacture-oriented point of view than is, for example, a diaphragm-hydraulic valve control.

The advantage of a simple design in the region of the hydraulic chamber 2 derives compared to a valve control with motion-commutating stroke transmission.

Figure 2:
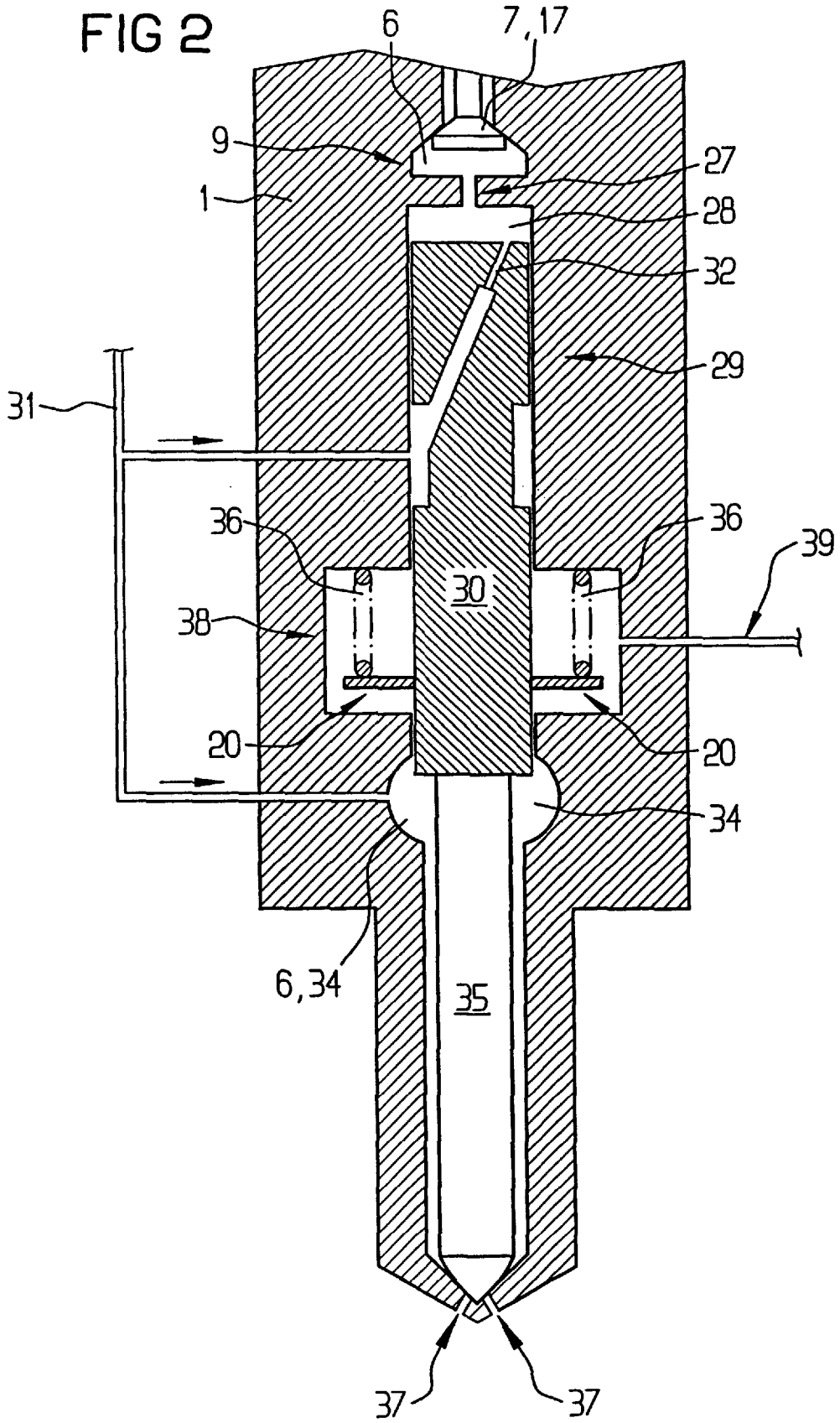
FIG. 2 shows elements of a fuel injection system regulated by the valve control.

In a sectional side view, FIG. 2 shows an application of the system shown in FIG. 1 for the valve control in an apparatus for dosing fluid. The throttled feeder 27 leads from the valve chamber 9 into a working chamber 28 that is supplied with fluid 6 via a feeder 31, for example via a common rail feeder under the full (rail) pressure of 100–2500 bar. The pressure in the working chamber 28 controls the motion of a working piston 30 guided axially displaceable in a further bore 29, whereby the fit can be hydraulically tight or affected by leakage. In this Figure, the connection between working chamber 28 and feeder 31 is achieved via a bore 32 conducted through the working piston 28 that is worked as a channel at its end adjoining the feeder 31 for compensating the motion of the working piston 30.

When, for example, the bore 32 is implemented throttled, working chamber 28 and gradual shutoff chamber 26 can also be implemented as one chamber that, for example, can be equipped with detents for limiting the stroke of the working piston 30.

An injection nozzle needle 35 with which one or more injection nozzles 37 can be closed is secured to that side of the working piston 30 facing away from the working chamber 28. A fuel chamber 34 that is likewise supplied with fluid 6 via the filling conduit 31 is provided at the same side of the working piston 30. The injection nozzle needle 35 is not guided hydraulically tight, so that fluid 6 proceeds unthrottled from the fuel chamber 34 to the injection nozzles 37 via the fit between injection nozzle needle 35 and housing 1.

A part of the bore 29 is expanded as nozzle needle spring chamber 38 in which a nozzle needle spring 36, which is supported at the housing 1, presses the working piston 30 against the injection nozzles 37. For example, the nozzle needle spring 36 is secured to the working piston 30 with a Seeger ring 20. Due to this nozzle needle spring 36, the at least one injection nozzle 37 is advantageously closed given an outage of the high-pressure system, and a delivery of fluid, for example of diesel or gasoline, into a combustion chamber of a motor is prevented.

A return conduit 39 via which the fluid 6 that has proceeded into the nozzle needle spring chamber 38 flows off discharges into the nozzle needle spring chamber 38.

Due to the pressure of the fluid 6 in the fuel chamber 34, the working piston 30 experiences a force that presses it in the direction of the working chamber 28. The pressure-active surface of the working piston 30 at the fuel chamber 34 is thereby smaller than that at the working chamber 28.

When the valve control is in quiescent position, i.e. the stroke element 7 closes the valve chamber 9 off from the outlet 10, then the full pressure delivered by the feeder 31 is also adjacent at the working chamber 28. The working piston 30 is pressed against the injection nozzles 37 and closes these.

During the stroke event, the pressure P2 in the valve chamber 9 drops, as, thus, does the pressure in the working chamber 28 as well. As a result thereof, the force acting on the working piston in the direction of the injection nozzles 37 is reduced to such an extent that the working piston 30 moves in the direction of the working chamber 20 and thus opens the injection nozzles 37. As a result thereof, the fluid 6 is output to the outside from the fuel chamber 34 via the at least one injection nozzle 37. A typical stroke of the working piston 30 amounts to 120–360 $\mu$m.

At the conclusion of the injection event, the valve chamber 9 is again closed relative to the outlet 10, so that the pressure is also built up again in the working chamber 28, and, thus, the working piston 30 again presses the injection nozzle needle 35 against the injection nozzles 37.

This application is especially advantageous in direct diesel injection with the assistance of a common high-pressure fuel rail 31 ("common rail").

The fluid 6 can be either a liquid, for example diesel, gasoline, kerosene or petroleum, or a gas as well, for example natural gas.

A device for dosing fluid constructed in this way has the advantage that the motion of a piezo actuator, which is already affected by only very small dead times, is transmitted practically delay-free onto the motion of the working piston.

Due to the high pressing capability of the piezo element, further, the very highly pressurized hydraulic circulation of the fluid dosing can be controlled by a comparatively slight static pressure in the hydraulic chamber 2. As a result thereof, it is possible to produce a well-dosed pilot injection, for example given fuel injection.

Figure 3:
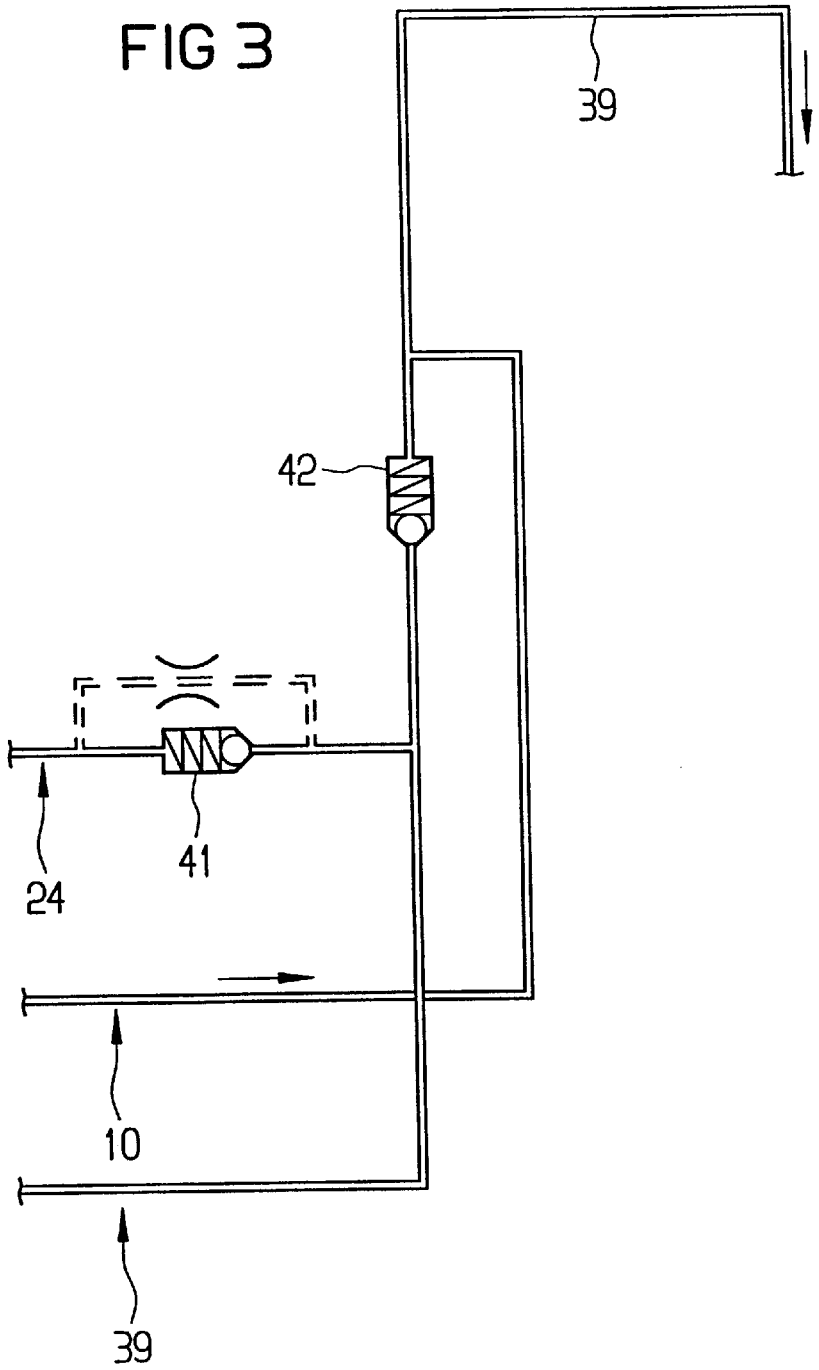
FIG. 3 shows pressure conduits belonging to the valve control and to the fuel injection system.

FIG. 3 schematically shows an advantageous development of the return system of an injection system according to FIGS. 1 and 2.

The fluid leaking from the fuel chamber 34 into the nozzle needle spring chamber 38 is carried off by the return conduit 39. A pressure-regulating valve 42 that dams up the pressure in the nozzle needle spring chamber 38, typically to 1–25 bar, is introduced in the return line 39. The filling conduit 24 branches off from the return conduit 42 above (in flow direction) the pressure-regulating valve 42. The outlet 10 discharges into the return conduit 39 under the pressure-regulating valve 42. When the filling conduit 24 is implemented throttled, the opening pressure of the pressure-regulating valve 42 corresponds to the static pressure, i.e. the pressure P1 in quiescent position, in the hydraulic chamber 2.

When the conduit 24 is equipped with a filling valve 41, then the static pressure in the hydraulic chamber 2 corresponds to the pressure difference between the opening pressure of pressure-regulating valve 42 and filling valve 41. Since the outlet 10 is at a lower pressure level than the return conduit 39 under the pressure-regulating valve 42, a continuous rinsing stream of fluid 6 derives through the hydraulic chamber 2 along the fit between stroke piston 14 and housing 1. The filling valve 41 is advantageous for a fast compensation of the leakage losses occurring during the actuation phase, whereas the simply throttled conduit 24 advantageously enables a simpler manufacture and a maintenance-free operation.

A merely throttled filling conduit 24 can, for example, be utilized in a drive of an injector with low pulse/pause ratios, as standard, for example, in direct diesel injection (for example, maximum injection duration of 4 ms every 24 ms given 5000 rpm). A compensation of the leakages occurring during the short actuation duration of the valve control (for example, 4 ms) is assured by relatively long pauses (for example, 20 ms).

Figure 4:
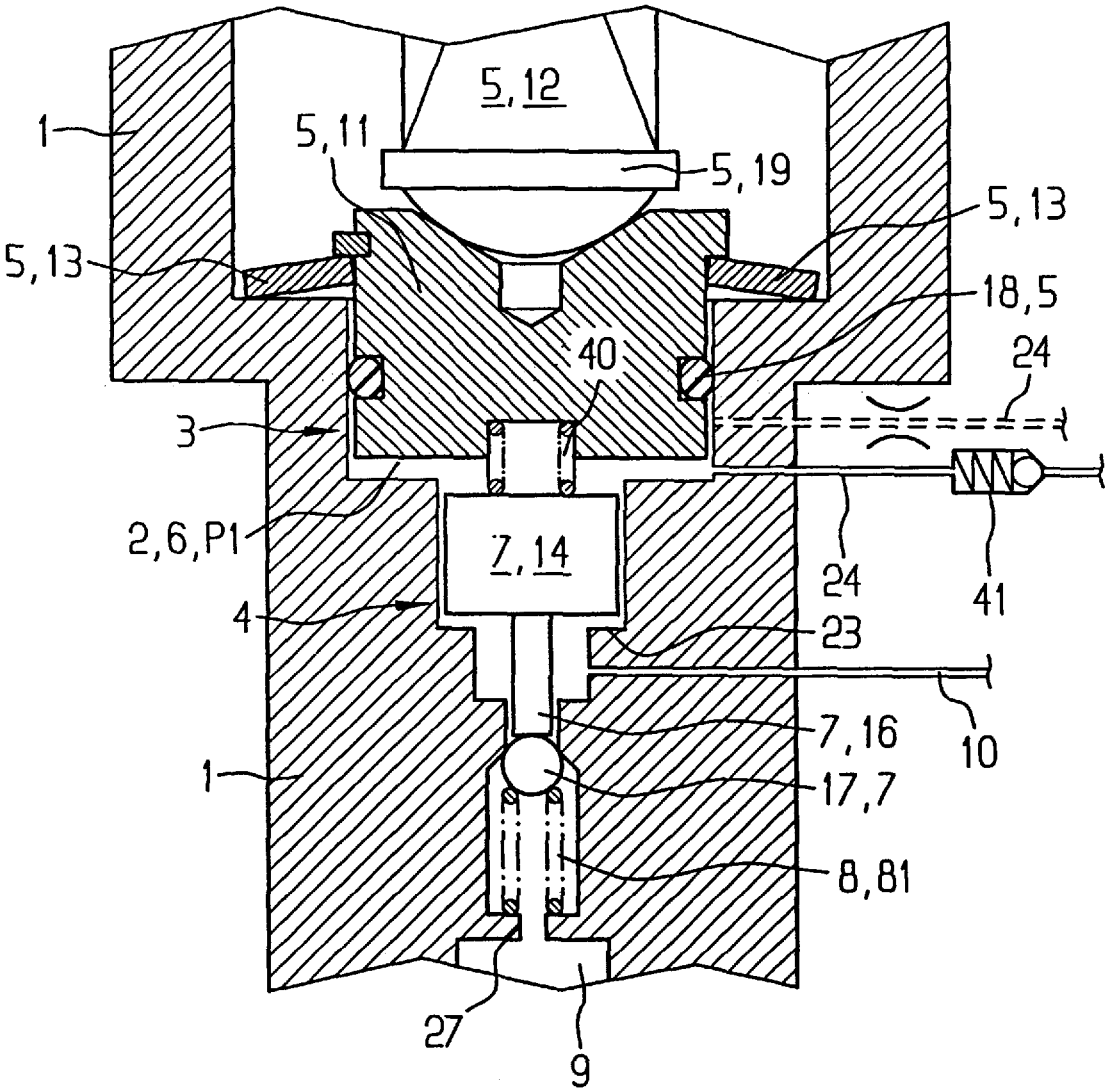
FIG. 4 shows a further embodiment of the valve control.

FIG. 4 schematically shows a sectional side view of a further advantageous development of the valve control with a simplified structure of elements at the secondary side.

This is achieved by the employment of a ball placed within the valve chamber 9 as seal element 17, whereby the ball is pressed against the orifice of the second bore 4 with a restoring element 8 of the secondary side in the form of a spring element 81 that is likewise accommodated within the valve chamber 9.

Compared to the valve control in FIG. 1, a design with piston rod 15 and ram 16 can be foregone in this embodiment. On the contrary, only a ram 16 is advantageously employed.

A piston spring 40 that assures the seating of the ram 16 against the ball is attached between pressure piston 11 and stroke piston 14. Given an adequately high pressure P1 in the hydraulic chamber 2 compared to the valve chamber 9 in quiescent position, the piston spring 40 can also be omitted because the stroke piston 14 is held seated with the ram 16 or ball in this case.

Compared to FIG. 1, the present embodiment is highly simplified in the region of the gradual shutoff chamber 26. On the other hand, the design selected in this Figure results in an enlargement of the noxious volumes of hydraulic chamber 2 and valve chamber 9, this involving a loss of efficiency.

The invention, of course, is not limited to the described exemplary embodiments. Instead of the piezoelectric actuating drive 12, thus, an electrostrictive or magnetostrictive actuator can be employed as actuating drive 12.

Further, for example, the position of sub-elements relative to one another can be differently designed, for example by a stroke element 7 completely let in in the second bore 4 or by a play of the individual sub-elements.

The embodiments in FIGS. 1, 2 and 4 have an essentially axial-symmetrical structure. Of course, one can depart from this in that, for example, the device for valve control is constructed of spatially distributed pressure chambers connected to one another via fluid conduits. However, a loss of functionality must thereby be accepted.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A device for valve control, the device having a primary side and a secondary side, comprising:

a housing having a hydraulic chamber, a first bore and a second bore such that the first bore and the second bore discharge into the hydraulic chamber;

a filling conduit via which the hydraulic chamber is pressure chargeable with a fluid;

a primary drive that is arranged at least partially in the first bore axially displaceable and affected by leakage or in hydraulically sealing fashion;

a stroke element that is arranged in the second bore axially displaceable and affected by leakage;

a restoring element of the secondary side that presses the stroke element in the direction of the hydraulic chamber;

a valve chamber that is connected via the second bore to the hydraulic chamber and into which the stroke element is displaceable;

a throttled conduit via which the valve chamber is pressure-chargeable with the fluid;

an outlet that is one of unpressurized or resides under a slight pressure;

a surface of the stroke element exposed pressure-actively to the fluid in the hydraulic chamber in motion direction being smaller than a surface of the primary drive;

a hydraulic friction connection between primary drive and stroke element;

the valve chamber being closeable relative to the outlet by the stroke element.

2. The device according to claim 1, wherein the filling conduit is one of throttled or equipped with a filling valve opening to the hydraulic chamber.

3. The device according to claim 1, wherein longitudinal axes of the first bore and of the second bore lie on a line.

4. The device according to claim 3, the primary drive has a pressure piston, an actuating drive and a restoring element of a primary side, and wherein the pressure piston is at least partially axially displaceable guidable in the first bore;

the restoring element of the primary side presses the pressure piston away from the hydraulic chamber; and the pressure piston is displaceable in the first bore with the actuating drive.

5. The device according to claim 4, wherein the device further comprises a spherical disk between one of the actuating drive and the pressure piston, or the actuating drive and the housing.

6. The device according to claim 4, wherein the actuating drive is one of a piezoelectric, electrostrictive or magnetostrictive element that is variable in expanse via terminal lines.

7. The device according to claim 4, wherein the restoring element of the primary side is a tubular spring.

8. The device according to claim 5, wherein the restoring element of the primary side is at least one saucer spring arranged above one another or next to one another for at least two saucer springs.

9. The device according to claim 1, wherein in addition to a restoring element of the primary side attached outside the hydraulic chamber, at least one spring element that press the primary drive away from the hydraulic chamber is attached within the hydraulic chamber.

10. The device according to claim 1, wherein the device further comprises at least one elastomer ring for sealing a fit between the primary drive and the housing.

11. The device according to claim 1, wherein an end of the stroke element pointing in a direction of the valve chamber has a seal element with which the valve chamber can be closed off from the outlet in quiescent position.

12. The device according to claim 1, wherein the second bore is partially expanded as a gradual shutoff chamber.

13. The device according to claim 1, wherein the stroke element is composed of:

a stroke piston that adjoins the hydraulic chamber, that is arranged in the second bore axially displaceable and affected with leakage, and whose pressure-active surface in the hydraulic chamber is smaller than a surface of the primary drive;

a seal element that adjoins the valve chamber in quiescent position and closes the valve chamber off from the outlet;

a piston rod that is attached to the stroke piston between the stroke piston and the seal element, and that is arranged hydraulically non-sealing in the second bore; and a ram that is attached hydraulically non-sealing between piston rod and seal element.

14. The device according to claim 12, wherein the outlet discharges into the gradual shutoff chamber.

15. The device according to claim 14, wherein the restoring element of the secondary side is located in the gradual shutoff chamber.

16. The device according to claim 1, wherein the restoring element of the secondary side has at least one spring element.

17. The device according to claim 13, wherein the device further comprises a compression spring that presses the piston rod in the direction of the valve chamber and that is situated in the gradual shutoff chamber.

18. The device according to claim 1, wherein the device further comprises a plurality of sub-systems of the secondary side that discharge into the hydraulic chamber.

19. The device according to claim 1, wherein the device is utilized for control of a hydraulic system.

20. The device according to claim 1, wherein the device is utilized for control of an injection system.

21. The device according to claim 20, wherein the valve chamber is connected to a working chamber via the throttled conduit, and wherein the working chamber is formed by the housing and a working piston that is guided axially displaceable and hydraulically sealed in a further bore of the housing;

the working chamber is supplied with the fluid by a feeder; and the motion of the working piston is controlled by pressure of the fluid in the working chamber.

22. The device according to claim 21, wherein the working chamber is connected to the feeder via a throttle bore conducted through the working piston.

23. The device according to claim 21, wherein the pressure of the fluid in the working chamber regulates an output of fluid out of the housing.

24. The device according to claim 23, wherein:

the working piston is connected to an injection nozzle needle that is guided non-sealing axially displaceable in the further bore;

the working piston is pressed away from the working chamber by a nozzle needle spring; and a fuel chamber pressure-charged with fluid via the feeder is present at that end of the working piston in the further bore facing away from the working chamber, so that the working piston is pressed in the direction of the working chamber by the pressure of the fluid in the fuel chamber;

so that, in quiescent position, the injection nozzle needle closes at least one injection nozzle that is in communication with the fuel chamber.

25. The device according to claim 20, wherein the fluid is one of gasoline, diesel, kerosene, petroleum or natural gas.

26. A method for valve control, comprising the steps of:

providing a first bore and a second bore that separately discharge into a hydraulic chamber in a housing;

providing a primary drive in the first bore axially displaceable and affected by leakage or in hydraulically sealing fashion;

providing a stroke element at least partially in the second bore axially displaceable and affected with leakage;

the hydraulic chamber being fillable with a fluid via a filling conduit;

the primary drive having a hydraulic friction connection with the stroke element via the hydraulic chamber;

the hydraulic chamber being connected via the second bore to a valve chamber, whereby the valve chamber is fillable with fluid via a throttled feeder;

providing a restoring element of a secondary side that presses the stroke element in a direction of the hydraulic chamber;

providing an outlet;

in quiescent position, displacing the primary drive maximally away from the hydraulic chamber, displacing the stroke element maximally in a direction of the hydraulic chamber thereby closing the valve chamber off from the outlet; during a stroke event, producing, via the primary drive, a volume of the hydraulic chamber, so that a first pressure of the fluid in the hydraulic chamber is increased until the stroke element is pushed stroke-translated away from the hydraulic chamber into the valve chamber, producing a connection between valve chamber and outlet is produced by the displacement of the stroke element, as a result whereof the fluid flows from the valve chamber into the outlet and a second pressure in the valve chamber thus becomes minimal;

upon return into the quiescent position, producing the primary drive away from the hydraulic chamber, so that the first pressure therein drops, as a result whereof the stroke element is displaced in the direction of the hydraulic chamber until the quiescent position is again reached and the second pressure in the valve chamber is again maximally built up, compensating fluid losses in the hydraulic chamber via the filling conduit.

27. The method according to claim 26, wherein the primary drive has a pressure piston, an actuating drive and a restoring element of a primary side, so that the pressure piston is at least partially guided in the first bore axially displaceable and hydraulically sealing or affected with leakage;

the restoring element of the primary side presses the pressure piston away from the hydraulic chamber; and the actuating drive is changed in length by applying an electrical signal such that the pressure piston is displaced in the first bore;

so that in quiescent position, a length of the actuating drive is minimal in longitudinal direction of the first bore, so that the pressure piston is pushed maximally away from the hydraulic chamber by the restoring element of the primary side and the first pressure of the fluid in the working chamber;

during the stroke event, the length of the actuating drive is increased in longitudinal direction of the first bore so that the pressure piston is pushed in the direction of the hydraulic chamber by the actuating drive;

upon return into the quiescent position, the length of the actuating drive is reduced in longitudinal direction of the first bore, so that the pressure piston is pushed away from the hydraulic chamber by the restoring element of the primary side and the first pressure of the fluid in the working chamber.

28. The method according to claim 26 for regulating an injection system, whereby the valve chamber is connected to a working chamber via a throttled feeder, wherein:

the working chamber is formed by the housing and a working piston guided in a further bore of the housing axially displaceable and hydraulically sealed or affected by leakage and is supplied with the fluid by a feeder;

the working piston is connected to an injection nozzle needle that is guided non-sealing axially displaceable in a further bore and is pressed away from the working chamber by a nozzle needle spring;

a fuel chamber is located at that end of the working piston in the further bore facing away from the working chamber, so that pressure of the fluid in the fuel chamber presses the working piston in the direction of the working chamber, whereby in quiescent position, the working piston is displaced maximally away from the working chamber, so that the injection nozzle needle closes at least one injection nozzle that is in communication with the fuel chamber;

during the stroke event, pressure in the working chamber drops due to a pressure drop in the valve chamber to such an extent that the working piston is displaced in the direction of the working chamber by pressure of the fluid in the fuel chamber, so that the fluid is moved from the housing through the at least one injection nozzle;

upon return into the quiescent position, the pressure in the working chamber rises due to pressure build-up in the valve chamber, so that, due to the pressure of the fluid in the working chamber on the working piston and due to the nozzle needle spring, the working piston is pressed in the direction of the working chamber until the quiescent position has again been reached.

29. The method according to claim 26, wherein the first pressure in the hydraulic chamber is in the range of 1–25 bar in quiescent position.

30. The method according to claim 26 wherein the second pressure in the valve chamber is in the range of 100–2500 bar in quiescent position.

31. The method according to claim 26, wherein the stroke of the actuating drive is in the range of 10–60 $\mu$m.

32. The method according to claim 26, wherein the stroke of the stroke element is in the range of 60–360 $\mu$m.

33. The method according to claim 28, wherein the stroke of the working piston is in the range of 120–360 $\mu$m.

34. The method according to claim 26, wherein motion of one of the primary drive or of the actuating element is based on one of a piezoelectric, electrostrictive or magnetostrictive principle.

* * * * *